US009198546B1

(12) United States Patent
Brown

(10) Patent No.: US 9,198,546 B1
(45) Date of Patent: Dec. 1, 2015

(54) WALL MOUNTABLE WIPE DISPENSER

(71) Applicant: Joshua J. E. Brown, Laguna Hills, CA (US)

(72) Inventor: Joshua J. E. Brown, Laguna Hills, CA (US)

( * ) Notice: Subject to any disclaimer, the term of this patent is extended or adjusted under 35 U.S.C. 154(b) by 120 days.

(21) Appl. No.: 14/097,518

(22) Filed: Dec. 5, 2013

(51) Int. Cl.
*A47K 10/42* (2006.01)

(52) U.S. Cl.
CPC ..... *A47K 10/421* (2013.01)

(58) Field of Classification Search
CPC ..... A47K 2010/3266; A47K 10/426
USPC ..... 206/494; 221/45, 46
See application file for complete search history.

(56) References Cited

U.S. PATENT DOCUMENTS

| | | | | |
|---|---|---|---|---|
| 819,482 | A * | 5/1906 | Wheeler | 221/46 |
| 2,537,050 | A * | 1/1951 | Gluck | 220/480 |
| 2,840,268 | A * | 6/1958 | Casey et al. | 221/49 |
| D372,615 | S | 8/1996 | Owens | |
| 5,687,875 | A * | 11/1997 | Watts et al. | 221/45 |
| 6,592,001 | B2 | 7/2003 | Lewis et al. | |
| 6,910,579 | B2 | 6/2005 | Reinke et al. | |
| 7,530,471 | B2 * | 5/2009 | Cohen et al. | 221/48 |
| 7,621,401 | B2 * | 11/2009 | Alegre de Miquel | 206/494 |
| 8,398,041 | B2 * | 3/2013 | Brinkdopke et al. | 248/316.7 |
| 2005/0133387 | A1 * | 6/2005 | Cohen et al. | 206/233 |
| 2006/0102508 | A1 | 5/2006 | Decristofaro et al. | |
| 2006/0118567 | A1 * | 6/2006 | Linnebur | 221/45 |
| 2006/0249528 | A1 * | 11/2006 | Myers | 221/283 |
| 2007/0175914 | A1 | 8/2007 | Warke | |
| 2007/0181594 | A1 | 8/2007 | Thompson | |
| 2012/0273514 | A1 * | 11/2012 | Sartini et al. | 221/45 |
| 2012/0305587 | A1 * | 12/2012 | Williford | 221/46 |

* cited by examiner

*Primary Examiner* — Patrick Mackey

(57) ABSTRACT

A flushable wipe dispenser device holds and dispenses flushable wipes adjacent to a toilet within a bathroom structure. The device includes a box having an open front side. A panel is couplable to the front side of the box. An aperture extends through the panel wherein the interior space of the box is accessible through the aperture. A diaphragm is coupled to and extends across the aperture in the panel. An opening extends through the diaphragm wherein the opening is configured for passing flushable wipes through the diaphragm. A cover is pivotally coupled to the panel selectively covering the opening through the panel.

12 Claims, 6 Drawing Sheets

WALL MOUNTABLE WIPE DISPENSER

BACKGROUND OF THE DISCLOSURE

Field of the Disclosure

The disclosure relates to dispenser devices and more particularly pertains to a new dispenser device for holding and dispensing flushable wipes adjacent to a toilet within a bathroom structure.

SUMMARY OF THE DISCLOSURE

An embodiment of the disclosure meets the needs presented above by generally comprising a box having an open front side. A panel is couplable to the front side of the box. An aperture extends through the panel wherein the interior space of the box is accessible through the aperture. A diaphragm is coupled to and extends across the aperture in the panel. An opening extends through the diaphragm wherein the opening is configured for passing flushable wipes through the diaphragm. A cover is pivotally coupled to the panel selectively covering the opening through the panel.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
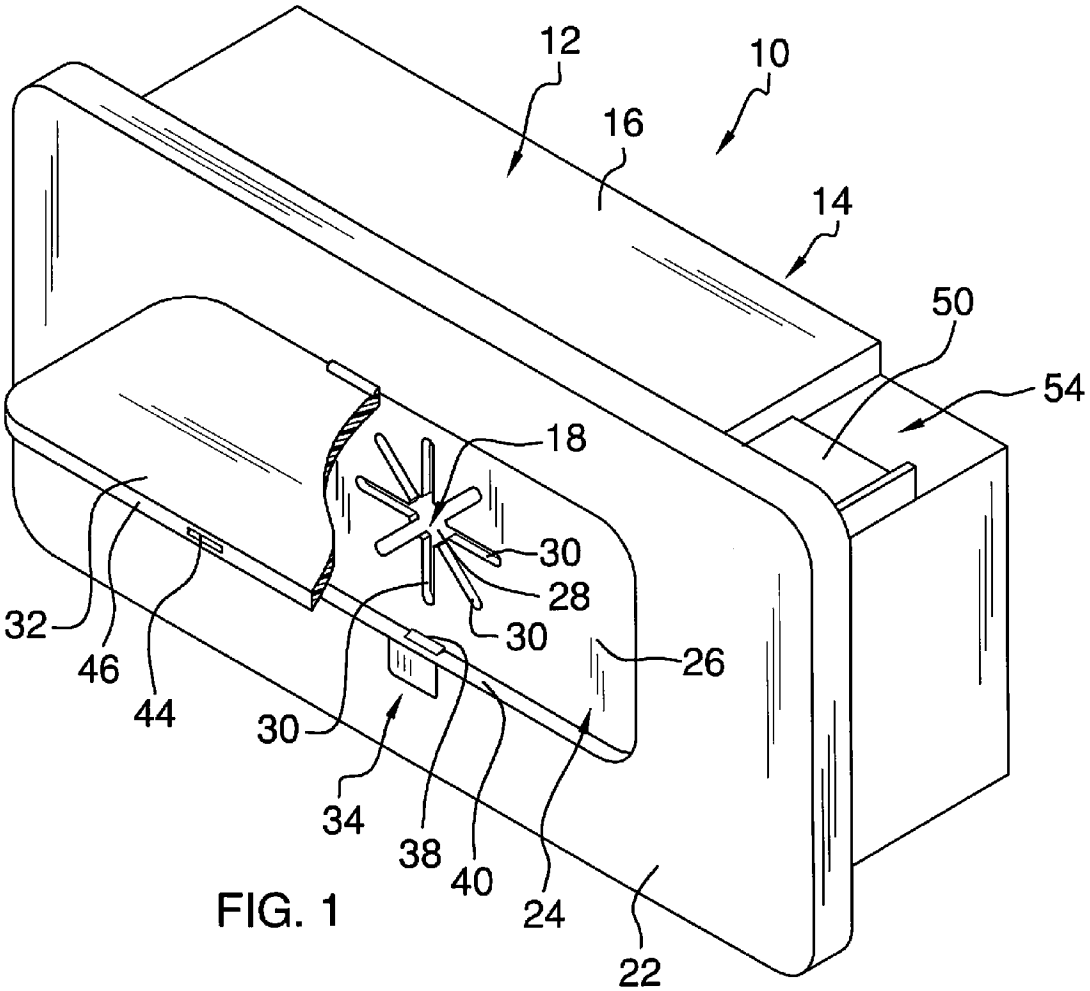
FIG. 1 is a partial cut-away top front side perspective view of a flushable wipe dispenser device according to an embodiment of the disclosure.

With reference now to the drawings, and in particular to FIGS. 1 through 7 thereof, a new dispenser device embodying the principles and concepts of an embodiment of the disclosure and generally designated by the reference numeral 10 will be described.

As best illustrated in FIGS. 1 through 7, the flushable wipe dispenser device 10 generally comprises a box 12 having a back wall 14 and a perimeter wall 16 coupled to and extending forwardly of the back wall 14 defining an interior space 18 of the box 12. The box 12 has an open front side 20 such that the box 12 is configured for receiving an holding a container of flushable wipes in the interior space 18. A panel 22 is couplable to the front side 20 of the box 12. An aperture 24 extends through the panel 22 wherein the interior space 18 of the box 12 is accessible through the aperture 24. A diaphragm 26 is coupled to the panel 22 and extends across the aperture 24 in the panel 22. An opening 28 extends through the diaphragm 26 wherein the opening 28 is configured for passing flushable wipes through the diaphragm 26. A plurality of radial slots 30 may extend from the opening 28 through the diaphragm 26 to facilitate passing the flushable wipes through the opening 28.

A cover 32 is pivotally coupled to the panel 22. The cover 32 selectively covers the opening 28 through the panel 22. A lock 34 selectively secures the cover 32 in a closed position 36 over the opening 28 to restrict access and to enclose the interior space 18 to prevent premature drying of the wipes if they are pre-moistened. The lock 34 may comprise a tab 38 extending from an interior edge 40 of the panel 22 defining the opening 28 through the panel 22. The tab 38 engages the cover 32 when the tab 38 is extending into the opening 28 from the interior edge 40 of the panel 22. A lock release 42 may be positioned on the panel 22. The lock release 42 may comprise a button or similar mechanism which is operationally coupled to the lock 34 such that the lock 34 is disengaged from the cover 32 by release or retraction of the tab 38 permitting pivoting of the cover 32 from the closed position 36 when the lock release 42 is manipulated. A groove 44 may extend into a peripheral edge 46 of the cover 32. The tab 38 is inserted into the groove 44 when the tab 38 is extended while the cover 32 is in the closed position 36. Thus, the tab 38 secures the cover 32 in the closed position 36. Each of a plurality of clips 48 extends from the box 12. The cover 32 engages the clips 48 such that the cover 32 is removably retained on the box 12 covering the front side 20 of the box 12.

Figure 2:
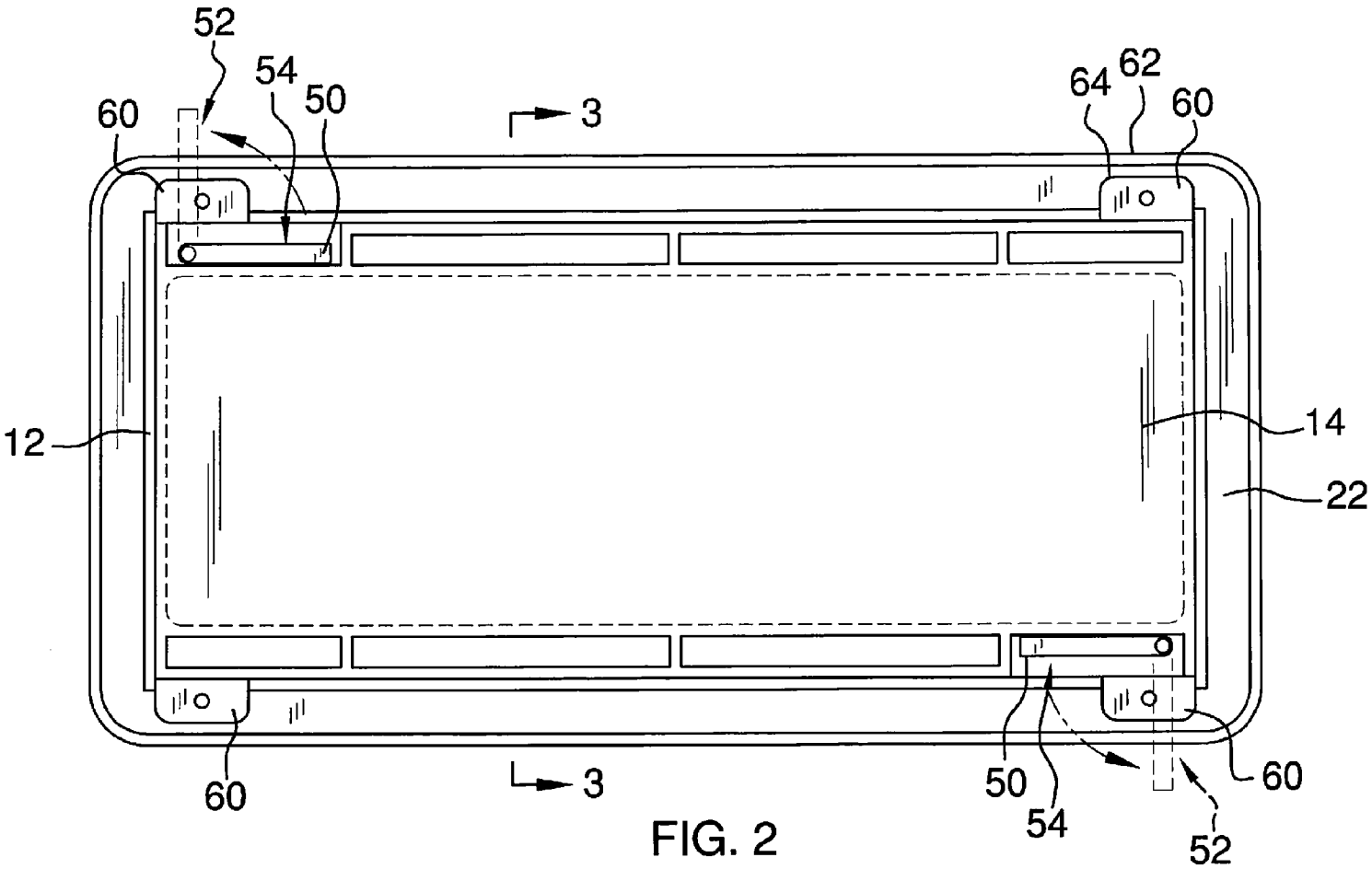
FIG. 2 is a back view of an embodiment of the disclosure.
Figure 4:
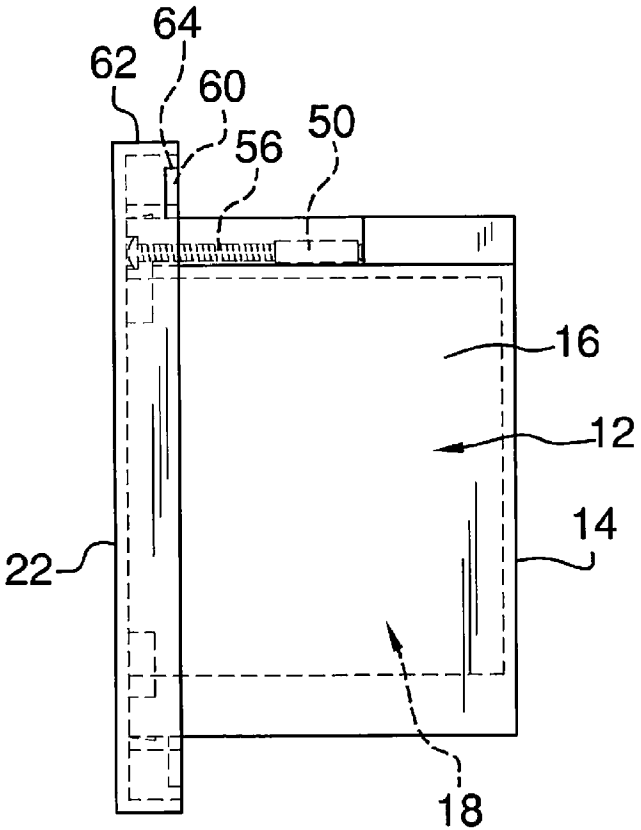
FIG. 4 is a side view of an embodiment of the disclosure.
Figure 3:
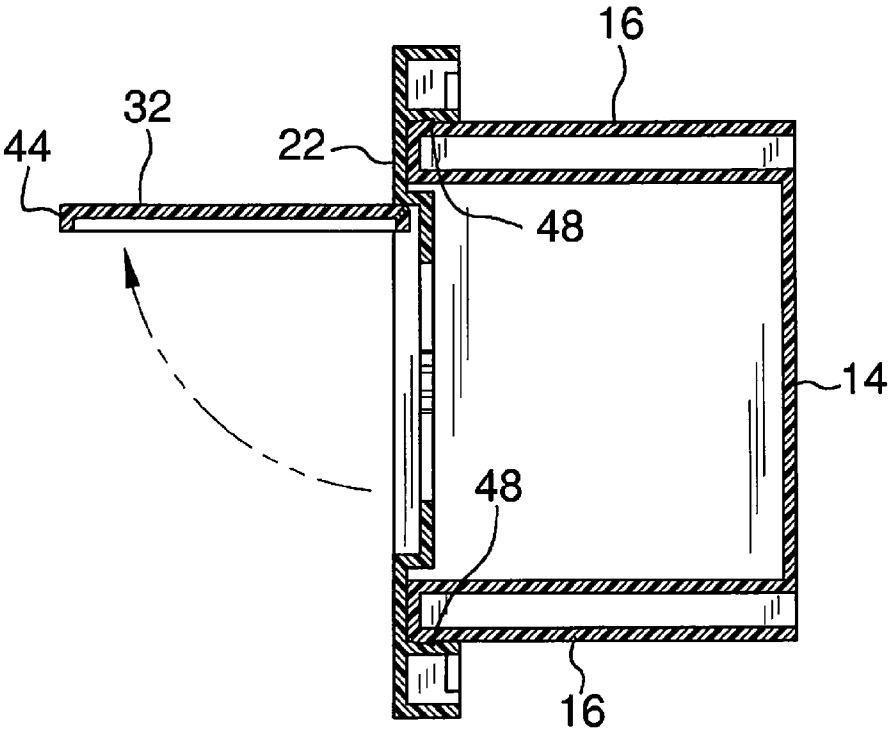
FIG. 3 is a cross-sectional view of an embodiment of the disclosure taken along line 3-3 of FIG. 2.
Figure 5:
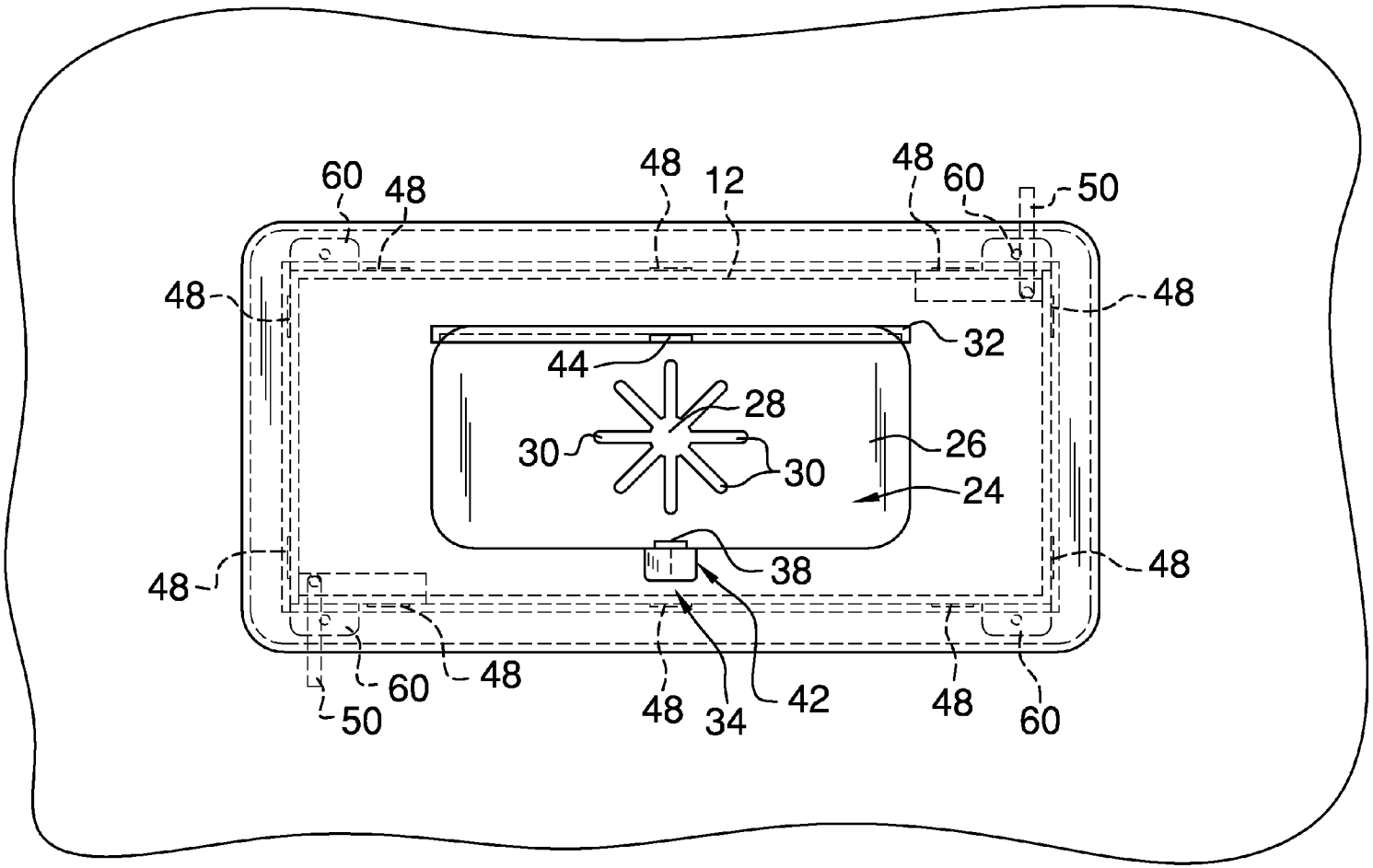
FIG. 5 is a front view of an embodiment of the disclosure.
Figure 6:
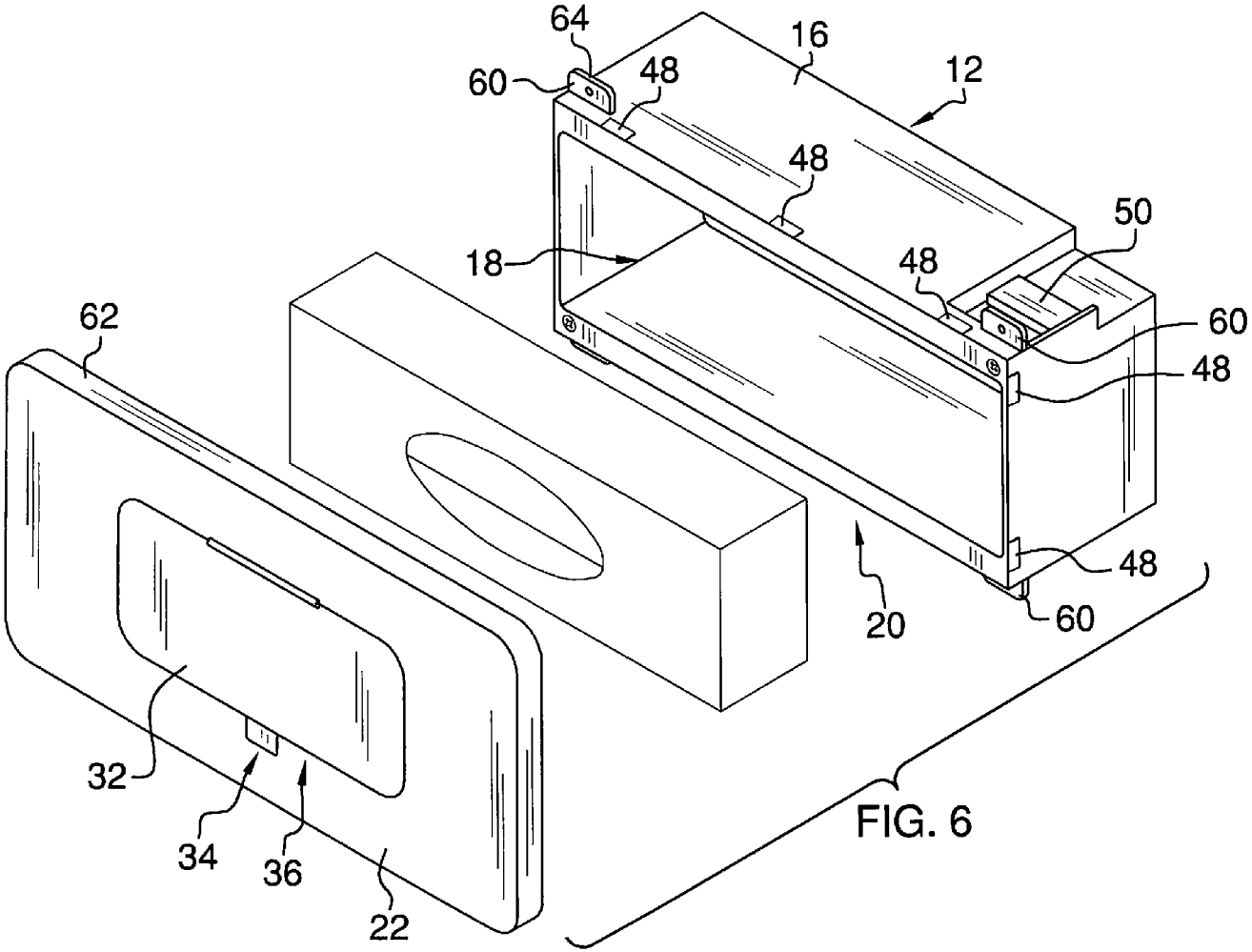
FIG. 6 is a partially exploded top front side perspective view of an embodiment of the disclosure.

In an embodiment shown particularly in FIGS. 2 and 4, a plurality of locking ears 50 is coupled to the perimeter wall 16 in spaced relationship rearwardly of the front side 20 of the box 12. Each of the locking ears 50 is pivotable between an extended position 52 and a retracted position 54. The locking ears 50 are inset into the perimeter wall 16 in the retracted position 54 facilitating insertion of the box 12 through a hole cut into a sheet of wall material such as drywall. The locking ears 50 extend outwardly from the perimeter wall 16 when in the extended position 52 wherein the locking ears 50 are configured for securing the box 12 to the sheet of wall material when the box 12 is inserted into a hole extending through the sheet of wall material. The locking ears 50 may be a pair of locking ears 50 positioned on diagonally opposed corners of the box 12. Each of a plurality of locking screws 56 has a threaded shaft 58 engaging an associated one of the locking ears 50 such that the associated locking ear 50 is rotated to the extended position 52 and urged towards the front side 20 of the box 12 when the locking screw 56 is tightened. Each of a plurality of spacing plates 60 extends outwardly from the box 12. Each spacing plate 60 is positioned in spaced parallel relationship to the front side 20 of the box 12. Thus, the sheet of wall material may be clamped between the spacing plates 60 and the locking ears 50 to secure the box 12. An outer perimeter edge 62 of the panel 22 is positioned in spaced relationship to a respective distal edge 64 of each spacing plate 60 when the panel 22 is coupled to the box 12 wherein the panel 22 obscures viewing of the spacing plates 60 after full installation.

Figure 7:
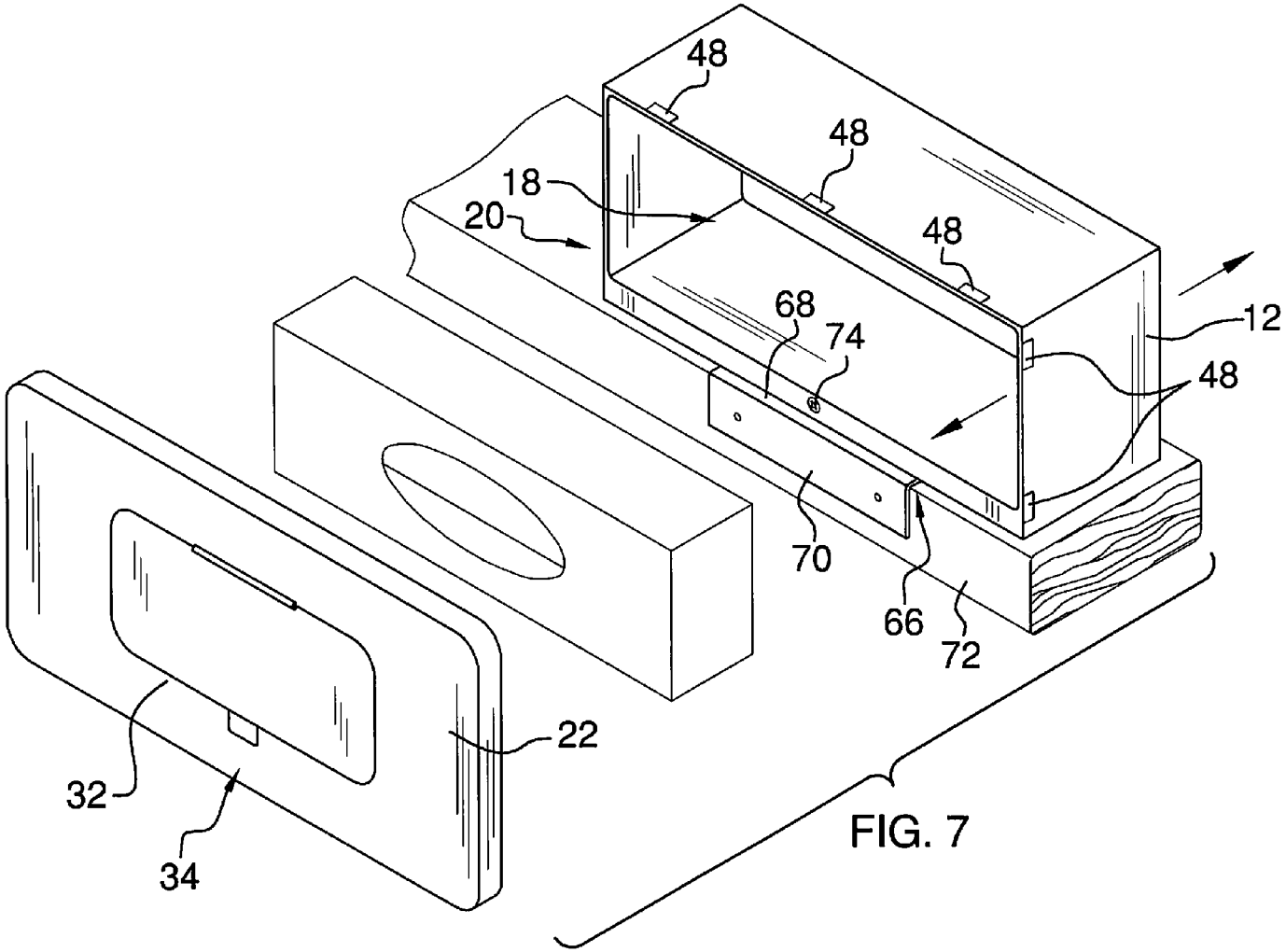
FIG. 7 is a partially exploded top front side perspective view of an embodiment of the disclosure.

Alternatively, as shown in FIG. 7, the box 12 may be secured using a bracket 66 having a first flange 68 coupled to the box 12 and a second flange 70 configured for coupling to a frame 72 of a structure wherein the box 12 is coupled to the frame 72 and is exposed through a hole in a sheet of wall material aligned with the box 12. a depth adjustment screw 74 of conventional design may be employed to couple the bracket 66 to the box 12 allowing for adjustment of the position of the front side 20 of the box 12 relative to the frame 72.

In use, the box 12 is secured in position on a wall using one of the above described structures. The panel 22 is secured to the box 12 and the cover 32 provides access to flushable wipes stored in the box 12 as needed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A flushable wipe dispenser device comprising:

a box having a back wall and a perimeter wall coupled to and extending forwardly of said back wall defining an interior space of said box, said box having an open front side;

a panel couplable to said front side of said box;

an aperture extending through said panel wherein said interior space of said box is accessible through said aperture;

a diaphragm coupled to and extending across said aperture in said panel;

an opening extending through said diaphragm wherein said opening is configured for passing flushable wipes through said diaphragm;

a cover pivotally coupled to said panel, said cover selectively covering said opening through said panel;

a plurality of locking ears coupled to said perimeter wall in spaced relationship rearwardly of said front side of said box, each of said locking ears being pivotable between an extended position and a retracted position, said locking ears being inset into said perimeter wall in said retracted position and extending outwardly from said perimeter wall when in said extended position wherein said locking ears are configured for securing said box to a sheet of wall material when said box is inserted into a hole extending through the sheet of wall material; and a plurality of locking screws, each locking screw having a threaded shaft engaging an associated one of said locking ears such that said associated locking ear is rotated to an extended position and urged towards said front side of said box when said locking screw is tightened.

2. The device of claim 1, further comprising a lock selectively securing said cover in a closed position over said opening.

3. The device of claim 2, further comprising a lock release positioned on said panel, said lock release being operationally coupled to said lock wherein said lock is disengaged from said cover permitting pivoting of said cover from said closed position when said lock release is manipulated.

4. The device of claim 2, further comprising said lock comprising a tab extending from an interior edge of said panel defining said opening through said panel, said tab engaging said cover when said tab is extending into said opening from said interior edge of said panel.

5. The device of claim 4, further comprising a groove extending into a peripheral edge of said cover, said tab being inserted into said groove when said tab is extended while said cover is in said closed position wherein said tab secures said cover in said closed position.

6. The device of claim 1, further comprising said locking ears being a pair of locking ears positioned on diagonally opposed corners of said box.

7. The device of claim 1, further comprising a plurality of radial slots extending from said opening through said diaphragm.

8. The device of claim 1, further comprising a plurality of clips extending from said box, said panel engaging said clips wherein said panel is removably retained on said box covering said front side of said box.

9. The device of claim 1, further comprising a plurality of spacing plates extending outwardly from said box, each said spacing plate being positioned in spaced parallel relationship to said front side of said box.

10. The device of claim 9, further comprising an outer perimeter edge of said panel being positioned in spaced relationship to a respective distal edge of each said spacing plate when said panel is coupled to said box wherein said panel obscures viewing of said spacing plates.

11. A flushable wipe dispenser device comprising:

a box having a back wall and a perimeter wall coupled to and extending forwardly of said back wall defining an interior space of said box, said box having an open front side;

a panel couplable to said front side of said box;

an aperture extending through said panel wherein said interior space of said box is accessible through said aperture;

a diaphragm coupled to and extending across said aperture in said panel;

an opening extending through said diaphragm wherein said opening is configured for passing flushable wipes through said diaphragm;

a plurality of radial slots extending from said opening through said diaphragm;

a cover pivotally coupled to said panel, said cover selectively covering said opening through said panel;

a lock selectively securing said cover in a closed position over said opening, said lock comprising a tab extending from an interior edge of said panel defining said opening through said panel, said tab engaging said cover when said tab is extending into said opening from said interior edge of said panel;

a lock release positioned on said panel, said lock release being operationally coupled to said lock wherein said lock is disengaged from said cover permitting pivoting of said cover from said closed position when said lock release is manipulated;

a groove extending into a peripheral edge of said cover, said tab being inserted into said groove when said tab is extended while said cover is in said closed position wherein said tab secures said cover in said closed position; and a plurality of clips extending from said box, said cover engaging said clips wherein said panel is removably retained on said box covering said front side of said box;

a plurality of locking ears coupled to said perimeter wall in spaced relationship rearwardly of said front side of said box, each of said locking ears being pivotable between an extended position and a retracted position, said locking ears being inset into said perimeter wall in said retracted position and extending outwardly from said perimeter wall when in said extended position wherein said locking ears are configured for securing said box to a sheet of wall material when said box is inserted into a hole extending through the sheet of wall material, said locking ears being a pair of locking ears positioned on diagonally opposed corners of said box; and a plurality of locking screws, each locking screw having a threaded shaft engaging an associated one of said locking ears such that said associated locking ear is rotated to an extended position and urged towards said front side of said box when said locking screw is tightened.

12. The device of claim 11, further comprising:

a plurality of spacing plates extending outwardly from said box, each said spacing plate being positioned in spaced parallel relationship to said front side of said box; and an outer perimeter edge of said panel being positioned in spaced relationship to a respective distal edge of each said spacing plate when said panel is coupled to said box wherein said panel obscures viewing of said spacing plates.

* * * * *